United States Patent [19]

Daggs et al.

[11] Patent Number: 4,565,466

[45] Date of Patent: Jan. 21, 1986

[54] RETURN JOINTED SIGN POST PEDESTAL

[76] Inventors: Paul R. Daggs, Rte. No. 2, Box 159-H, Yukon, Okla. 73099; Arthur C. Wilkowske, Rte. 3, Box 132-W, El Reno, Okla. 73036; Gordon D. Miller, Rte. 2, Box 79, Calumet, Okla. 73014

[21] Appl. No.: 623,205

[22] Filed: Jun. 21, 1984

[51] Int. Cl.[4] ..... E01F 9/01

[52] U.S. Cl. ..... 404/10; 40/608; 40/612; 52/1

[58] Field of Search ..... 52/98, 38, 169.13, 108, 52/1; 404/10, 11; 40/608, 612; 256/1, 13.1

[56] References Cited

U.S. PATENT DOCUMENTS

| | | | |
|---|---|---|---|
| 1,402,465 | 1/1922 | Wood . | |
| 1,435,363 | 11/1922 | Wood . | |
| 1,679,623 | 8/1928 | Olsen . | |
| 1,939,968 | 12/1933 | Frei, Jr. | 40/612 X |
| 2,141,067 | 12/1938 | Miller . | |
| 3,435,201 | 12/1969 | Kelley . | |
| 3,693,940 | 9/1972 | Kendall et al. | 404/10 X |
| 3,838,661 | 10/1974 | Medley, Jr. . | |
| 4,106,879 | 8/1978 | Diedershagen et al. | 404/10 |
| 4,137,662 | 2/1979 | Baumer | 40/608 X |
| 4,270,873 | 6/1981 | Laehy et al. | 40/612 X |

*Primary Examiner*—Carl D. Friedman
*Assistant Examiner*—Creighton Smith
*Attorney, Agent, or Firm*—C. Clark Dougherty, Jr.

[57] ABSTRACT

A return jointed sign post pedestal which returns a knocked-down post attached thereto to its original position is provided. The pedestal includes an elongated tubular base member which flares into an upwardly facing fluted bell. A top member for attachment to the lower end of a sign post formed in the shape of a fluted bell complementary to and fitting in nesting relationship within the fluted bell portion of the base member is connected to the base member by biasing means. The biasing means urge the top and base members together with the fluted bell portions thereof positioned in nesting relationship so that when a sign post attached to the pedestal is knocked down, the top member rotates with respect to the base member while being prevented from swiveling and is returned to its original position by the biasing means.

10 Claims, 8 Drawing Figures

RETURN JOINTED SIGN POST PEDESTAL

BACKGROUND OF THE INVENTION

1. Field of the Invention

The present invention relates generally to a return jointed sign post pedestal, and more particularly, but not by way of limitation, to a sign post pedestal which returns a knocked-down post attached thereto to its original position.

2. Description of the Prior Art

Numerous pedestals for sign posts, lamp posts and the like have been developed which function to minimize the damage sustained by the posts when knocked down. Generally, the pedestals separate in a manner whereby the posts can be manually reinstalled in their original positions with a minimum of time and expense. For example, lamp posts are commonly bolted to pedestals at or near ground level using bolts of selected strength such that when the posts are impacted, the bolts break and allow the posts to be knocked to the ground prior to sustaining more severe damage.

In all of the prior pedestal arrangements for mounting posts and minimizing the damage thereto upon impact, the knocked-down posts must be manually reset and bolted or otherwise reattached to a pedestal or base member. Road signs such as stop signs generally do not include special pedestal apparatus and are attached to the ground by being set in concrete. When such road signs are knocked down, they must be reset manually using additional concrete, etc.

By the present invention a return jointed sign post pedestal is provided which allows a sign post attached thereto to be knocked down without separating therefrom and which then automatically returns the sign post to its original position.

SUMMARY OF THE INVENTTION

A jointed sign post pedestal which returns a knocked-down post attached thereto to its original position comprised of an elongated tubular base member adapted for vertical attachment in the ground and having the upper end flared into an upwardly facing fluted bell; a top member adapted to be attached to the bottom of a sign post formed in the shape of a fluted bell complementary to and adapted to fit in nesting relationship within the fluted bell portion of the base member; and biasing means connected between the base member and the top member which urge the members together with the fluted bell portions thereof positioned in nesting relationship. When a sign post attached to the pedestal is knocked down, the top member rotates with respect to the base member while being prevented from swiveling and is then returned along with the sign post to its original position by the biasing means.

It is, therefore, a general object of the present invention to provide a return jointed sign post pedestal.

A further object of the present invention is the provision of a sign post pedestal which when a sign post attached thereto is impacted, allows the sign to be knocked down while remaining attached to the pedestal and then returns the sign post to its original position.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a top view of the pedestal base member taken along line 6–6 of FIG. 4.

DESCRIPTION OF PREFERRED EMBODIMENTS

Figure 1:
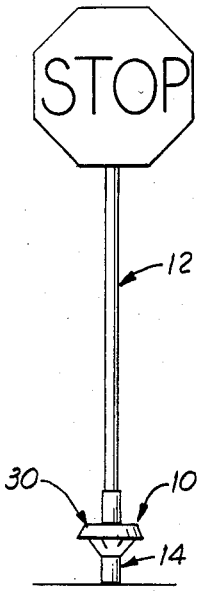
FIG. 1 is a side elevational view of a stop sign attached to the pedestal apparatus of the present invention.
Figure 2:
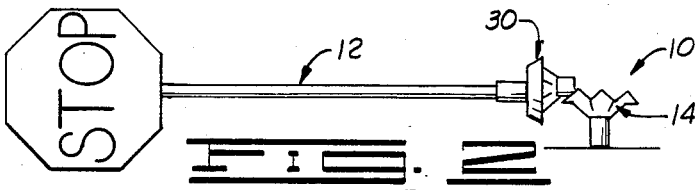
FIG. 2. is a view similar to FIG. 1 but showing the stop sign and pedestal after being knocked down.

Referring now to the drawings and particularly to FIGS. 1 and 2, the return jointed pedestal of the present invention, generally designated by the numeral 10, is illustrated fixed to the ground and attached to a stop sign post 12. As shown in FIG. 2, when the stop sign post 12 is impacted by an out-of-control automobile or other vehicle or object, it is knocked down and the pedestal 10 pivots with the post 12 without becoming separated therefrom. The pedestal 10 then automatically returns the stop sign and post to their original upright position as shown in FIG. 1.

Figure 3:
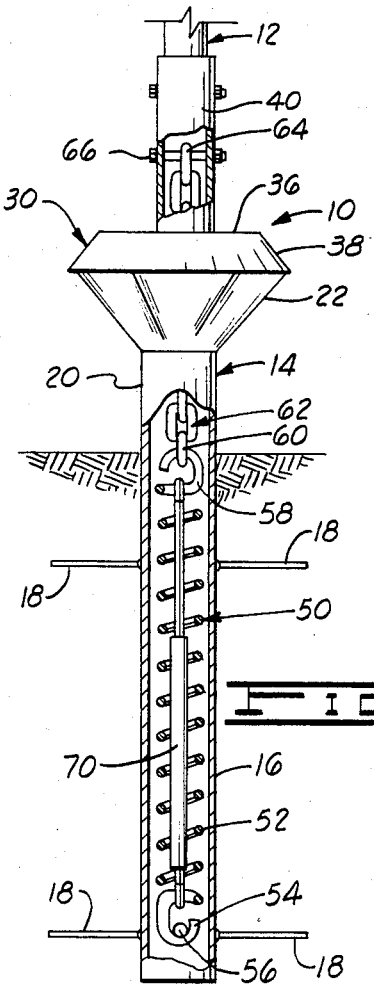
FIG. 3 is a side partially sectional view of the pedestal apparatus of the present invention.
Figure 4:
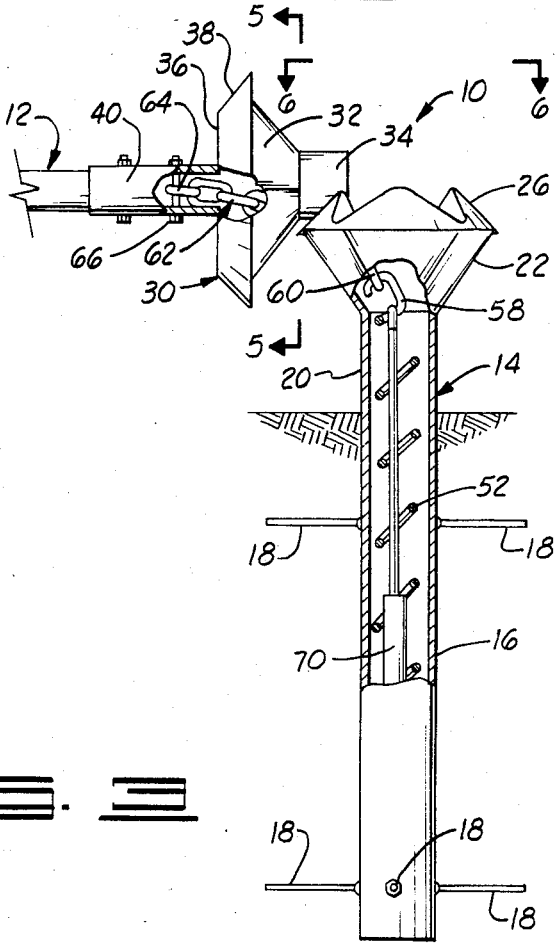
FIG. 4 is a side partly sectional view of the pedestal apparatus of FIG. 3 with the top member thereof rotated with respect to the base member thereof.
Figure 7:
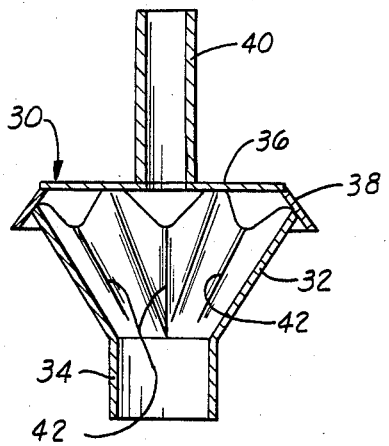
FIG. 7 is a cross-sectional view taken along line 7–7 of FIG. 5.
Figure 8:
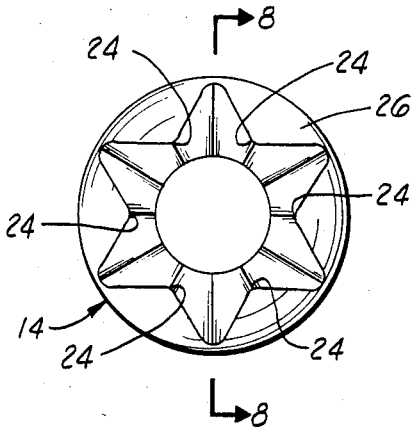
FIG. 8 is a cross-sectional view taken along line 8–8 of FIG. 6.
Figure 8:
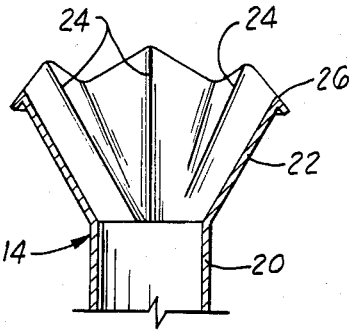

Referring now to FIGS. 3-8, the pedestal 10 is shown in detail. The pedestal 10 is comprised of an elongated tubular base member 14, the lower end portion 16 of which is adapted for vertical attachment to the ground. That is, the tubular portion 16 includes a plurality of horizontally extending retaining rods 18 attached thereto for retaining the base member 14 in concrete in a vertical position. The upper end portion 20 of the base member 14 is positioned above ground level, and as best shown in FIGS. 4, 6 and 8, the portion 20 flares into an upwardly facing fluted bell 22 which includes six longitudinal inwardly extending flutes 24. An outwardly and downwardly extending skirt 26 is attached to the top periphery of the bell 22.

Figure 5:
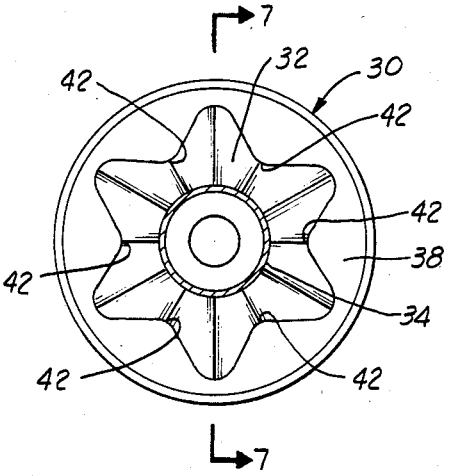
FIG. 5 is a cross-sectional view of the pedestal top member taken along 5—5 of FIG. 4.

A top member 30 is positioned above the base member 14, and as shown in FIGS. 4, 5 and 7, the member 30 also includes a fluted bell portion 32 which is complementary in size and shape to the fluted bell 22 of the base member 14. As best shown in FIG. 3, the fluted bell portion 32 of the top member 30 fits in nesting relationship within the fluted bell portion 22 of the base member 14. In addition to the bell portion 32, the top member 30 includes a short tubular segment 34 at the lower end thereof. An annular plate 36 is attached at the top of the bell portion 32 and a downwardly extending flared skirt 38 is attached to the periphery of the plate 36. Attached to and extending vertically upwardly from and over the central opening in the plate 36 is a sleeve 40 which is in turn attached to the lower end of the sign post 12. As mentioned, the fluted bell portion 32 of the top member 30 is of a shape and size complementary to the fluted bell portion 22 of the base member 14, i.e., the bell portion 32 includes six flutes 42. In addition, the tubular segment 34 of the top member 30 is of a smaller outside diameter than the inside diameter of the tubular portion of the base member 14 adjacent the bell portion 22 thereof whereby when the bell portions of the members 14 and 30 are fitted together, the tubular segment 34 fits within the tubular portion of the base member 14.

Referring specifically to FIGS. 3 and 4, a biasing means, generally designated by the numeral 50, is connected between the base member 14 and top member 30 whereby the members are urged together with the fluted bell portions thereof positioned in nesting relationship. While various biasing means can be utilized lized including various types of springs, the biasing means 50 is preferably comprised of a tension spring 52 disposed within the base member 14 connected at the lower end 54 thereof to the lower end of the tubular portion 16 of the base member 14 by a bolt 56. The upper end 58 of the spring 52 is connected to the lower end 60 of a chain 62, the upper end 64 of which is connected to the sleeve 40 of the top member 30 by a bolt 66.

The spring means 50 optionally also includes a hydraulic or air cushioning unit 70 connected between the ends 54 and 58 of thereof. The cushioning unit 70 operates similarly to an automobile shock absorber and functions to slow down the return rate of the tension spring 52 after it has been extended.

OPERATION OF THE PEDESTAL 10

As shown in FIGS. 1–3, the pedestal 10 is normally positioned with the fluted bell portion 32 of the top member 30 held in rigid nesting relationship within the fluted bell portion 22 of the base member 14 by the tension spring 52 and chain 62 attached therebetween. In this mode of the pedestal 10, the sign post 12 attached to the sleeve 40 of the top member 30 is not only held in a vertical position but is prevented from swiveling with respect to the base 14 by the flutes 24 and 42 of the base member 14 and top member 30, respectively.

When the sign post 12 is impacted and knocked down as illustrated in FIG. 2, the joint formed between the base member 14 and top member 30 of the pedestal 10 rotates with the sign post 12. As shown in FIG. 4, the top member 30 pivots with respect to the base member 14 which causes the fluted bell portion 32 of the top member 30 to be withdrawn from within the fluted bell portion 22 of the base member 14 whereby the tension spring 52 is extended. The tubular segment 34 of the top member 30 remains in contact and is pivoted on the top of the base member 14 and the member 30 remains attached to the spring 52 by the chain 62.

After the sign post 12 becomes free of the object which knocked it down or other obstacles, the force exerted on the top member 30 by the spring 52 and chain 62 causes the tubular segment 34 of the top member 30 to pivot on the base 14 and the top member 30 to move back into the fluted bell portion 22 of the base member 14 whereby the sign post 12 is moved back to a vertical position. As the fluted bell portion 32 of the top member 30 rotates and moves into the fluted bell portion 22 of the base 14, the flutes 24 and 42 re-engage whereby the sign post 12 is prevented from swiveling with respect to the base 14. As mentioned, the cushioning unit 70, when included in the pedestal 10, slows down the rate of return of the spring 52 whereby the sign post 12 is restored to its original position relatively slowly as opposed to snapping back into position.

Thus, the return jointed sign post pedestal of the present invention rotates at a joint therein when a sign post attached thereto is knocked down, returns the sign post to its original position after it has become free of any restraining obstacles and prevents the sign post from swiveling during the processes of being knocked down and returning to the vertical position. The pedestal of this invention is well adapted, therefore, to carry out the objects and attain the ends and advantages mentioned as well as those inherent therein. While numerous changes in the construction and arrangement of parts will suggest themselves to those skilled in the art, such changes are encompassed within the spirit of this invention as defined by the appended claims.

What is claimed is:

1. A jointed sign post pedestal which returns a knocked-down post attached thereto to its original position comprising:

an elongated tubular base member, the lower end portion of which is adapted for vertical attachment below ground level and the upper end portion of which flares into an upwardly facing fluted bell;

a top member formed in the shape of a fluted bell which is complementary to and fits in nesting relationship within the fluted bell portion of said base member adapted for attachment to the lower end of a vertically positioned sign post, the fluted bell portion of said top member terminating at its lower end in a tubular segment which fits and extends into a tubular portion of said base member when the fluted bell portions of said top and base members are positioned in nesting relationship; and biasing means connected between said base member and said top member which urge said members together with the fluted bell portions thereof positioned in nesting relationship so that when a sign post attached to said pedestal is knocked down, said top member rotates with respect to said base member while being prevented from swiveling by the flutes of said fluted bell portions and then is returned along with said sign post to its original position by said biasing means.

2. The apparatus of claim 1 wherein said biasing means are comprised of an elongated tension spring positioned within the tubular portion of said base member and attached thereto at the lower end thereof and a chain attached between the upper end of said spring and said top member.

3. The apparatus of claim 2 wherein said top member is further characterized to include an annular plate attached to the top thereof with a vertically positioned tubular member adapted for attachment to said sign post connected thereto.

4. The apparatus of claim 3 wherein said top member is further characterized to include a downwardly extending flared skirt attached to the periphery of said plate.

5. The apparatus of claim 4 wherein said base member is further characterized to include a downwardly extending flared skirt attached to the top of the fluted bell portion thereof.

6. The apparatus of claim 2 which is further characterized to include cushioning means connected between the ends of said tension spring for cushioning and slowing down the return rate of said spring.

7. A jointed sign post pedestal which returns a knocked-down post attached thereto to its original position comprising:

an elongated tubular base member, the lower end portion of which is adapted for vertical attachment below. ground level and the upper end portion of which flares into an upwardly facing bell;

a top member formed in the shape of a bell which is complementary to and fits in nesting relationship within the bell portion of said base member adapted for attachment to the lower end of a vertically positioned sign post, the bell portion of said top member terminating at its lower end in a tubular segment which fits and extends into the tubular portion of said base member when the bell portions of said top and base members are positioned in nesting relationship;

an elongated tension spring positioned within the tubular portion of said base member and attached thereto; and a chain attached between the upper end of said tension spring and said top member whereby said members are urged together with the bell portions thereof positioned in nesting relationship so that when a sign post attached to said pedestal is knocked down, said top member rotates with respect to said base member and then is returned along with said sign post to an upright position.

8. The apparatus of claim 7 wherein said top member is further characterized to include an annular plate attached to the top thereof with a vertically positioned tubular member adapted for attachment to said sign post connected thereto.

9. The apparatus of claim 8 wherein said top member is further characterized to include a downwardly extending flared skirt attached to the periphery thereof.

10. The apparatus of claim 9 wherein said base member is further characterized to include a downardly extending flared skirt attached to the top of the bell portion thereof.

* * * * *